United States Patent [19]

Miles et al.

[11] 4,206,735

[45] Jun. 10, 1980

[54] MECHANICAL THROTTLE BODY INJECTION APPARATUS

[75] Inventors: Donald L. Miles, Troy; Paul E. Reinke, Rochester, both of Mich.

[73] Assignee: General Motors Corporation, Detroit, Mich.

[21] Appl. No.: 931,157

[22] Filed: Aug. 4, 1978

[51] Int. Cl.[2] ..... F02M 39/00

[52] U.S. Cl. ..... 123/139 AW; 261/36 A; 261/39 D; 261/50 A

[58] Field of Search ..... 123/139 AW; 261/36 A, 261/39 D, 50 A

[56] References Cited

U.S. PATENT DOCUMENTS

| | | | |
|---|---|---|---|
| 2,785,669 | 3/1957 | Armstrong | 123/119 |
| 2,958,321 | 11/1960 | Haase | 123/139 AW |
| 3,680,535 | 8/1972 | Eckert et al. | 123/139 AW |
| 3,728,993 | 4/1973 | Eckert et al. | 123/139 AW |
| 3,730,155 | 5/1973 | Knapp | 123/139 AW |
| 3,739,762 | 6/1973 | Jackson | 123/139 AW |
| 3,765,387 | 10/1973 | Knapp | 261/39 D |
| 4,046,121 | 9/1977 | Pierlot | 261/50 A |
| 4,075,995 | 2/1978 | Kramer | 123/139 AW |
| 4,089,308 | 5/1978 | Pierlot | 261/50 A |

*Primary Examiner*—Ira S. Lazarus
*Assistant Examiner*—Magdalen Moy

[57] ABSTRACT

A mechanical, throttle body injection apparatus has an air valve positioned metering rod controlling fuel flow from a constant pressure fuel source through one side of a pressure regulator valve to a nozzle for continuous fuel injection into the throttle bore of the throttle valve controlling induction flow therethrough. Excess fuel, not metered by the metering rod, applies a control pressure to the other side of the pressure regulator valve and is returned to a fuel reservoir via a drain passage, flow through which is controlled by a pulse width modulated solenoid valve. The apparatus includes means for fuel enrichment at cold start and during engine warm-up.

11 Claims, 7 Drawing Figures

MECHANICAL THROTTLE BODY INJECTION APPARATUS

FIELD OF THE INVENTION

This invention relates to an air-fuel supply system for an internal combustion engine, and, in particular, to a mechanical throttle body injection apparatus for continuously supplying fuel and air to the intake manifold of a gasoline engine.

BACKGROUND OF THE INVENTION

Various systems for the injection of fuel under pressure into the induction air flow through the intake manifold of an engine are well known in the art. In one such system, as presently used in certain commercially available passenger vehicles, and as disclosed, for example, in U.S. Pat. No. 3,680,535, entitled "Fuel Injection System for Combustion Engines" issued Aug. 1, 1972 to Konrad Eckert, Heinrich Knapp, Reinhard Schwartz and Gregor Schuster, the continuous port injection of fuel under pressure is mechanically controlled by means of an air sensor controlling fuel flow to the engine, a throttle valve in a separate throttle body being used to control air flow to the engine.

In another such system, fuel, as controlled either mechanically or electrically, is injected under pressure into a common induction passage so that the resulting air-fuel mixture can be applied by the intake manifold to all cylinders of the engine. This latter type system which is a type of pressure carburetor may also be referred to as a throttle body injection system.

SUMMARY OF THE INVENTION

The present invention provides a pressure carburetor or mechanical, throttle body injection apparatus that is operative to continuously inject low pressure fuel into the induction passage of a gasoline engine whereby a controlled air-fuel mixture can be continuously supplied to the intake manifold of the engine for distribution to all of the cylinders of the engine, fuel metering being controlled in relation to movement of a carburetor air valve, with supplemental means being provided to provide closed loop control of fuel flow and to effect enrichment of the air-fuel mixture during cold start and engine warm-up.

Accordingly, the primary object of this invention is to improve a mechanical, throttle body injection apparatus that is operative with fuel at a low supply pressure whereby to supply a controlled air-fuel mixture via an intake manifold to the cylinders of an engine.

Another object of this invention is to improve a mechanical, throttle body injection apparatus whereby a fuel metering rod operatively connected to the carburetor air valve of the apparatus is used to control fuel metering as a function of the rotative position of a carburetor air valve and thus as a function of air flow through the apparatus.

A further object of this invention is to improve a mechanical throttle body injection apparatus having separate means operative during engine cold start and warm-up whereby to enrich the air-fuel mixture supplied to the engine during such operating conditions.

For a better understanding of the invention, as well as other objects and further features thereof, reference is had to the following detailed description of the invention to be read in connection with the accompanying drawings.

DESCRIPTION OF THE PREFERRED EMBODIMENT

Figure 1:
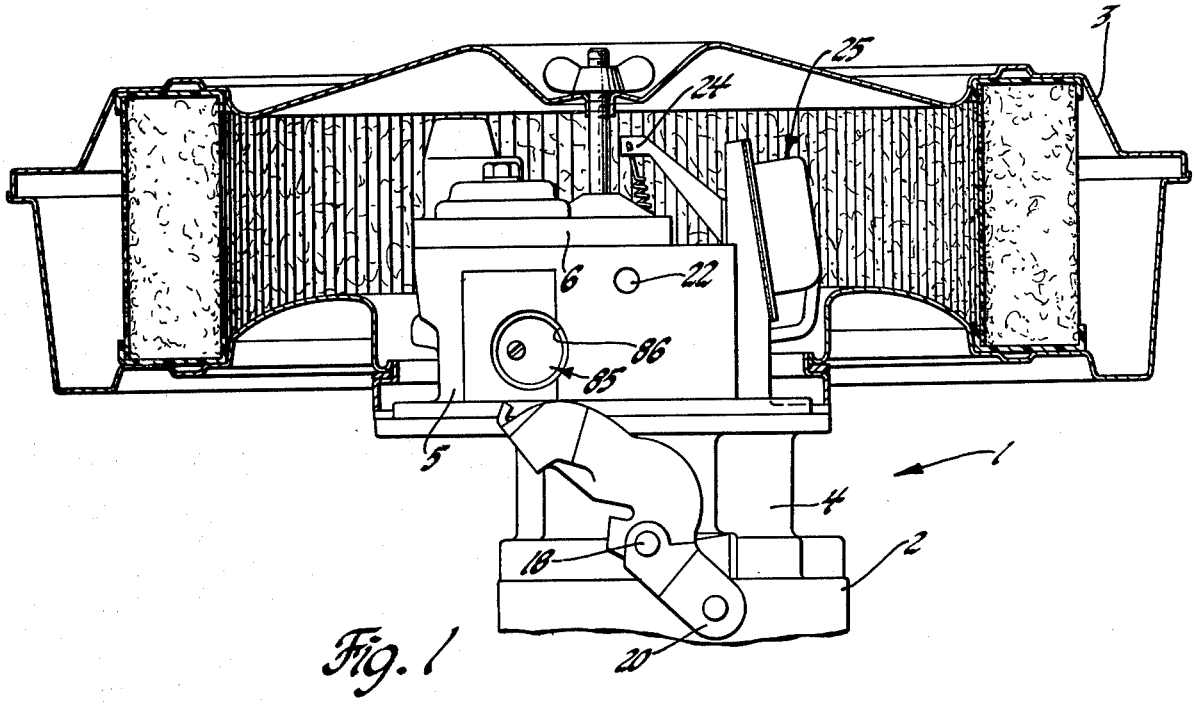
FIG. 1 is a side elevational view of a preferred embodiment of a mechanical throttle body injection apparatus, in accordance with the invention, shown in position on an engine intake mannifold, the apparatus having a conventional air cleaner mounted thereon.

Referring first to FIG. 1, the pressure carburetor or mechanical, throttle body injection apparatus, generally designated 1, of the invention is shown fixed over the inlet of an engine intake manifold 2 for an engine in the same manner as a conventional carburetor, with the apparatus supporting a conventional air cleaner 3.

For ease of manufacturing and assembly, the housing or body of the throttle body injection apparatus 1, in the construction illustrated, includes a throttle body 4 and a two-piece fuel body that includes a fuel body 5 and a cover 6, these elements being suitably secured together into a unitary carburetor body.

In the construction shown, this housing is provided with a pair of spaced apart air-fuel induction passages 7, each with an air intake 8 at one end and an outlet 9 at the other end for flow communication with the inlet of the intake manifold 2. Each such induction passage 7 is provided by a through bore 10 in the fuel body 5 extending from an upper surface 11 to a lower surface 12, this bore 10 being coaxial with an associated throttle bore 14 in the throttle body 4 that extends therethrough from an upper surface 15 to a lower surface 16.

Flow through each induction passage 7 is controlled by a throttle valve 17 fixed to a throttle shaft 18 rotatably journaled in the throttle body 4 and provided at one end with a throttle lever 20 for connection to a manually actuated accelerator pedal, not shown, in a conventional manner.

Each induction passage 7, upstream of its associated throttle valve 17, is provided with a choke or air valve 21 fixed to a pivot shaft 22 journaled in the fuel body 5 for pivotal movement about an axis off-set from the axis of the bores 10. The air valves 21 are normally biased toward a closed position relative to the induction passages 7 by means of calibrated coil springs 23. Each such spring 23 is suitably fixed at one end to an associated air valve 21 and is fixed at its other end to a support bracket 24 secured to the fuel body 5.

A regulator, generally designated 25, is used to control the open position of the air valves 21 whereby to maintain a substantially constant pressure drop across these air valves. In the construction shown, the fuel body 5 is provided with a recessed cavity 26 located intermediate the induction passages 7 and this cavity 26 is covered by a diaphragm 27 which is sandwiched between the fuel body 5 and a regulator cover 28 suitably fixed to the fuel body. The diaphragm 27 forms with the regulator cover 28, a chamber 30 that is in communication via a conduit 31 with an air induction passage 7 downstream of an air valve 21 associated therewith and, the diaphragm 27 forms with the cavity 26 a pressure chamber 32 which is in communication with the atmosphere of air flow above the air valves 21 through an enlarged opening 5*a* in a wall of the fuel body which loosely receives an actuator lever 33 suitably fixed at one end as by a rivet 34 to the diaphragm 27 so as to extend at right angles therefrom. The free end of the actuator lever 33 pivotally receives an intermediate portion of a U-shaped lever 35 which has its opposite ends pivotally engaged in the apertured ends of spaced apart, L-shaped valve levers 36, each of the valve levers 36 being operatively fixed to an air valve 21 as by the screws 37 used to fix each air valve to the pivot shaft 22.

Fuel to be mixed with the induction air flow through the induction passages 7, is injected into these passages by means of suitably pressure actuated fuel injection nozzles, generally designated 40, which in the construction schematically illustrated, are in the form of mechanical pressure relief poppet type valves. Accordingly, in the construction shown, the fuel body 5 is provided with a pair of nozzle extensions 41, each of which extend into an associated throttle bore 10 and has a nozzle body 42 fixed thereto at its free end, with the spray tip or outlet end 43 of each nozzle body 42 positioned substantially concentric with the axis of the respective throttle bore 14 so as to effect discharge fuel therefrom above the associated throttle valve 17 in the throttle bore 14. Fuel discharge from the spray outlet end 43 of each nozzle is controlled by an outward opening poppet valve 44 which is normally biased to a closed position by a calibrated spring 45.

Fuel to be discharged from each nozzle 40 into its associated throttle bore is supplied to the nozzle by having the internal fuel passage 46 in the nozzle body 42 connected in flow communication with one end of a passage 47 provided for this purpose in each of the nozzle extensions 41. During normal engine operation, metered fuel is supplied to each of the passages 47 for discharge through the associated injection nozzle 40 as supplied via a constant pressure fuel source as controlled by a metering valve 70 and by a constant differential pressure valve or pressure regulator valve 85 associated with each nozzle, all to be described in detail hereinafter.

Figure 3:
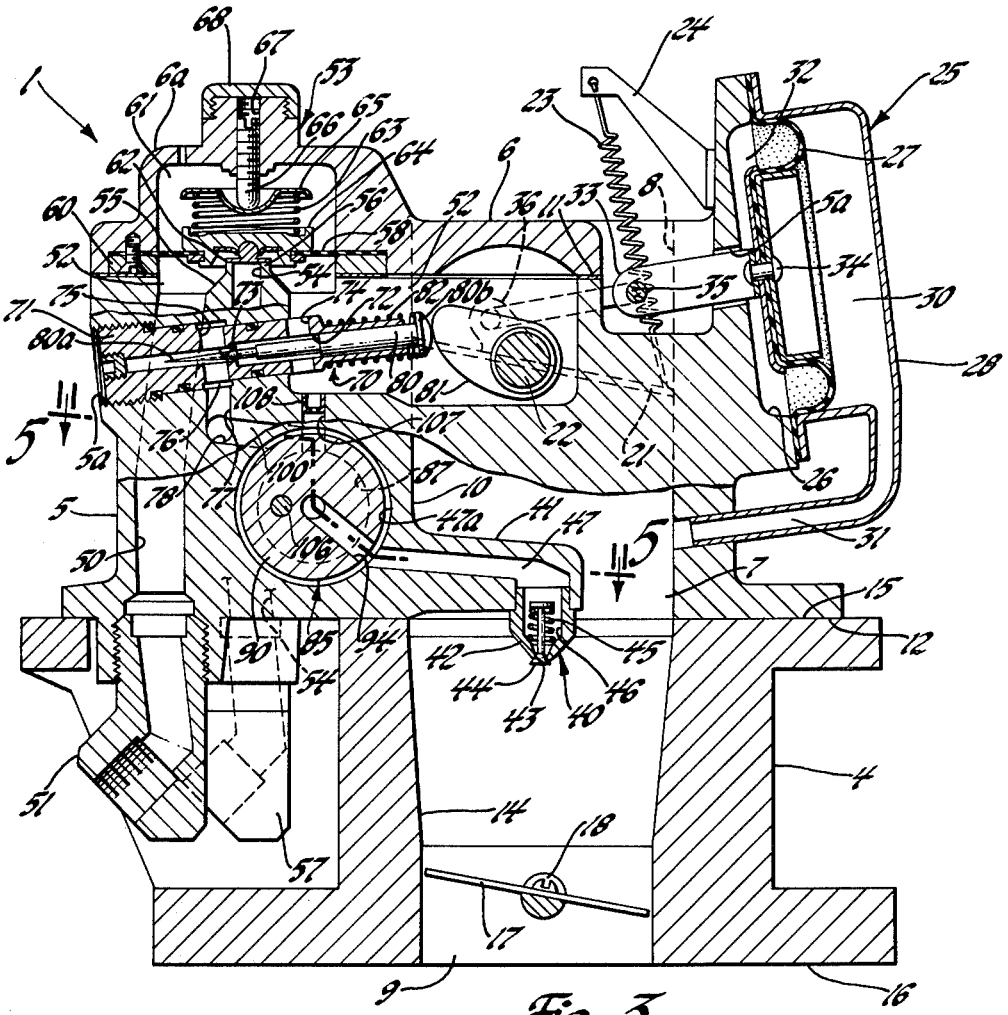
FIG. 3 is a sectional view of the throttle body injection apparatus taken along a line corresponding to line 3—3 of FIG. 2, but with parts further broken away to show details of the fuel metering system.
Figure 7:
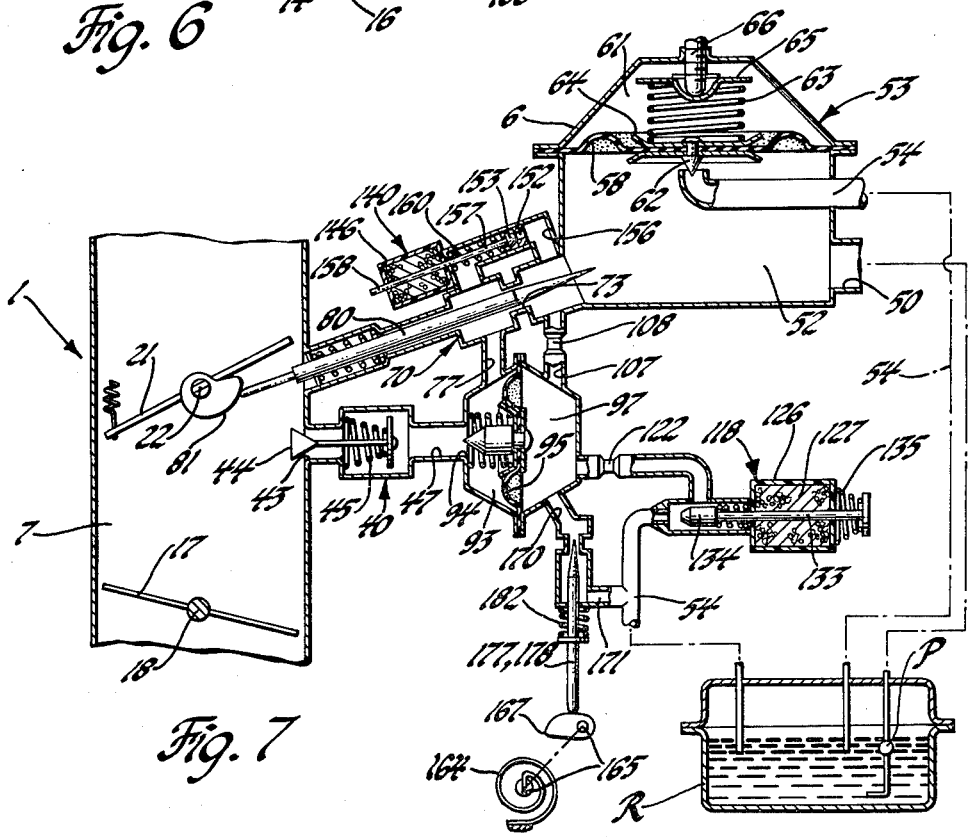
FIG. 7 is a schematic functional view of the main operating elements of the throttle body injection apparatus in accordance with the invention.

In the construction illustrated, the fuel body 5 is provided with a fuel inlet passage 50 connected at one end as by a conduit fitting 51 to a source of pressurized fuel as supplied, for example, from a fuel tanker reservoir R by a fuel pump, such as an in-tank fuel pump P, as shown schematically in FIG. 7. As best seen in FIG. 3, the other end of the inlet passage 50 is in communication with an elongated fuel supply chamber 52 provided by a compartment formed in the fuel body 5 and enclosed by the cover 6.

To provide fuel at constant pressure, a fuel pressure regulator can either be located upstream of the inlet passage 50, or as shown, the fuel pressure regulator, generally designated 53, can be located upstream of the inlet end of the fuel passage 50, and thus formed as an integral part of the throttle body injection apparatus. Thus in the construction shown, the fuel pressure regulator 53 includes a through drain passage 54 in the fuel body 5 that extends through an upstanding boss 55 projecting into the fuel chamber 52 directly beneath the inverted cup-shaped portion of cover 6, this boss 55 thus providing a valve seat 56 encircling one end of the drain passage 54. The opposite end of drain passage 54 is connectable via a drain conduit fitting 57 to a drain conduit DP whereby excess fuel can be returned to the fuel reservoir R, as shown in FIG. 7. A diaphragm 58 has its outer peripheral surface fixed to enclose the lower open end of the inverted, cup-shaped portion 6*a* of cover 6, as by having this portion of the diaphragm sandwiched between the lower surface of the cover 6 and a diaphragm retaining ring 60 suitably fixed to the cover. The diaphragm 58 forms, in effect, a movable wall portion of supply chamber 52 and separates this supply chamber from a compartment 61 in the cover 6, this compartment 61 being vented to the fuel tank or reservoir R, in a manner to be described.

The pressure of fuel flowing through the supply chamber 52 is controlled by controlling flow of excess fuel to the drain passage 54 by means of a valve member 62 fixed to the diaphragm 58 for movement therewith between a closed position at which the disc end of the valve member 62 engages the valve seat 56 blocking flow from the supply chamber 52 to the drain passage 54 and an open position at which the disc end of the valve member 62 is out of engagement with the valve seat 56, thereby permitting flow from the supply chamber 52 into the drain passage 54. The valve member 62 is normally biased with a predetermined force to its closed position by means of a spring 63 positioned in the compartment 61 so to abut at one end against a disc retainer 64 fixed to the diaphragm 58 on the compartment side thereof, the spring 63 having its other end abutting against a spring seat 65 that is adjustably positioned axially within the compartment 61 by a spring pressure adjusting screw 66 threaded into an internally threaded aperture 67 in the cover 6, a closure cap 68 being threadedly secured to the cover to enclose the adjusting screw 66.

Fuel at a controlled pressure from the supply chamber 52 then flows, as metered by a suitable metering valve 70, to opposite sides or chambers of one of the pressure regulator valves 85 used to control fuel flow to the injection nozzles 40 by control of the pressure drop across the outlet means of the fuel metering valve 70.

Figure 6:
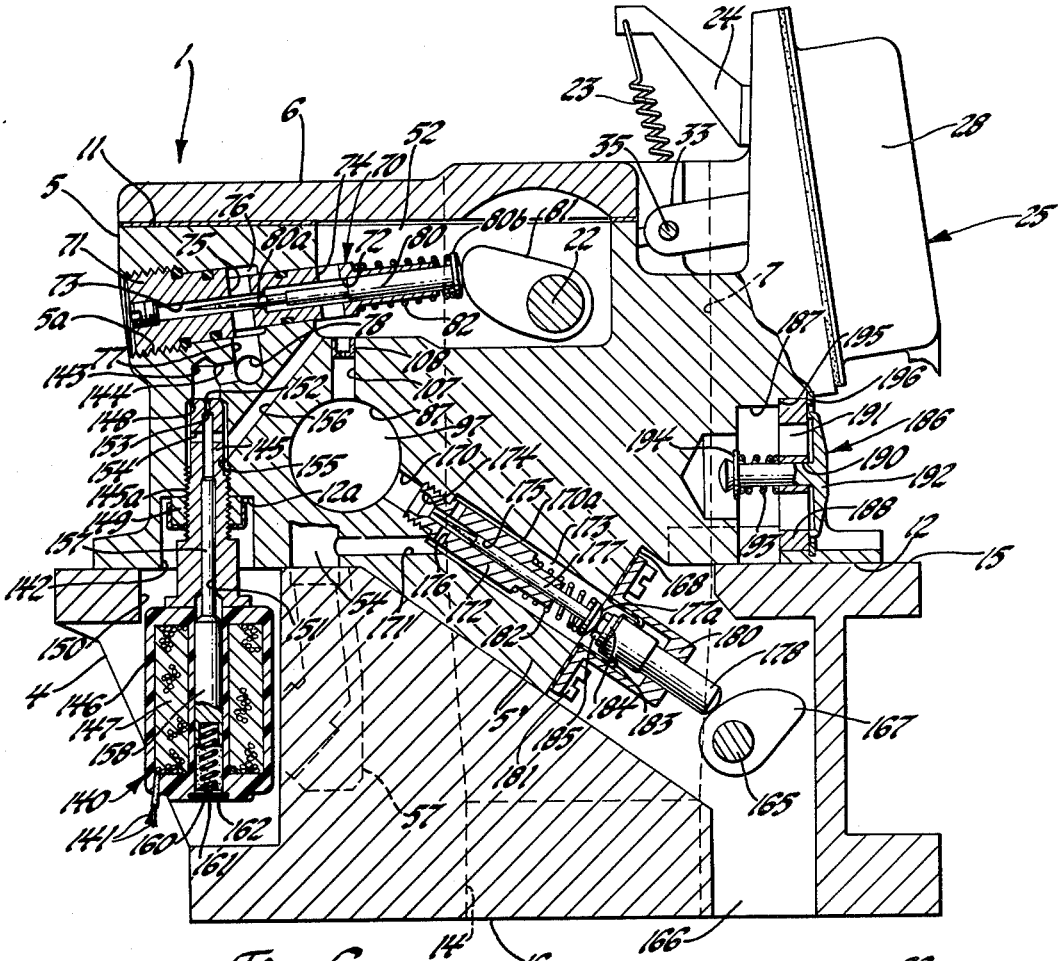
FIG. 6 is a sectional view taken along line 6—6 of FIG. 2.

Although the fuel metering valve 70 may be of any suitable type, in the embodiment shown, the metering valve 70 includes a valve bushing 71 adjustably threaded into an internally threaded bore 5*a* provided in the fuel body 5, as best seen in FIGS. 3 and 6, so as to extend from an exterior surface thereof to breakout into one end of the supply chamber 52. Valve bushing 71 is provided with an axial blind stepped bore extended from its reduced diameter free end to provide an enlarged cylinder bore 72 extending from this end and a reduced diameter bore 73 at its opposite end which terminates at an end wall 71*a*. Intermediate its end, valve bushing 71 is provided with one or more radial inlet ports 74 in communication with the bore 72 and, axially spaced therefrom, with radial discharge ports 75 communicating with the bore 73 and via annular fuel groove 76 that encircles the discharge ports 75 and a depending passage 77 to a cross passage 78 provided in the fuel body. A tapered metering rod 80 is slidably received in the cylinder bore 72 with the tapered end 80*a* of the metering rod loosely projecting into the bore 73 to form therewith a variable area flow orifice passage between the ports 74 and 75.

Figure 2:
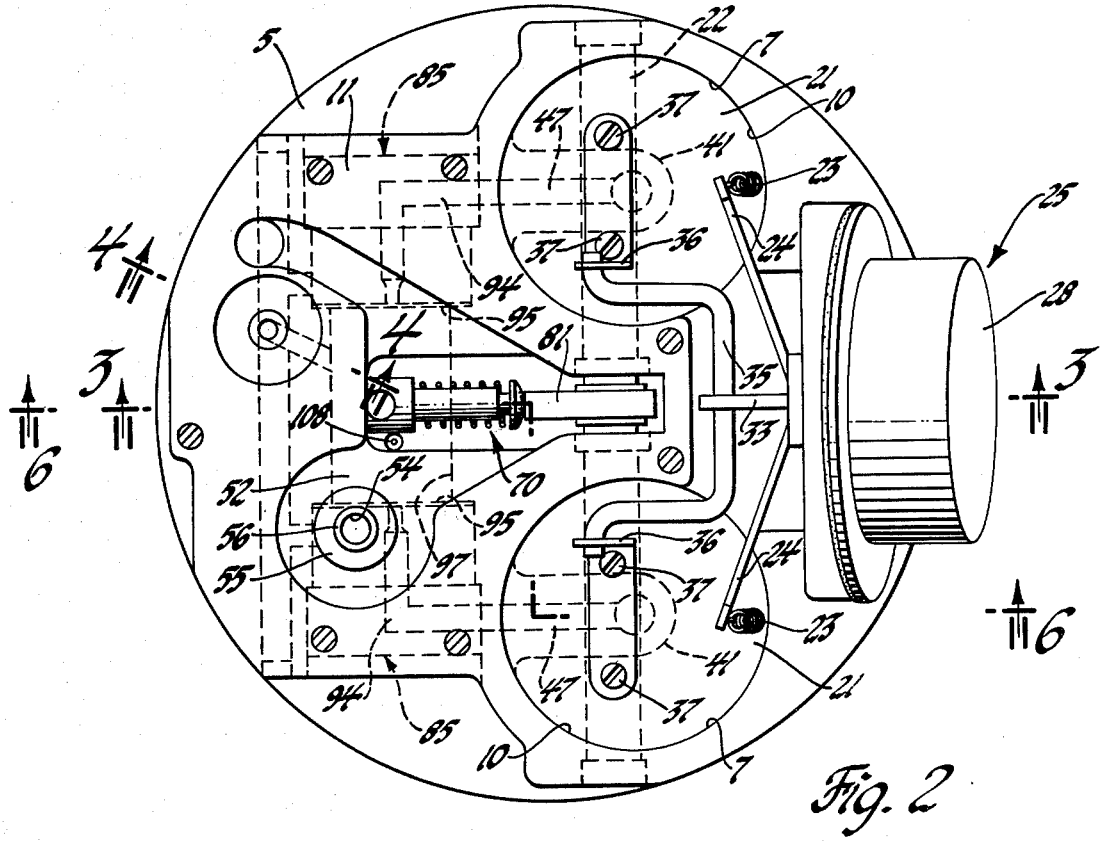
FIG. 2 is a top view of the throttle body injection apparatus of FIG. 1 with both the air cleaner and the cover of the apparatus removed, as well as certain elements normally positioned in the fuel body of the apparatus.

As seen in FIGS. 2, 3 and 6, a fuel metering cam 81, of a predetermined profile, is fixed to the pivot shaft 22, intermediate its ends, for rotation therewith, this cam being positioned in the supply chamber 52 in position to abut against the enlarged end or head 80*b* of the metering rod 80 whereby to effect axial movement thereof and, specifically, axial inward movement of the metering rod, a spring 82, encircling the metering rod 80 in position to abut at one end against its head 80*b* and at its opposite end against a suitable shoulder of the valve bushing, being used to normally bias the metering rod 80 for outward axial movement thereof relative to the valve bushing.

Figure 5:
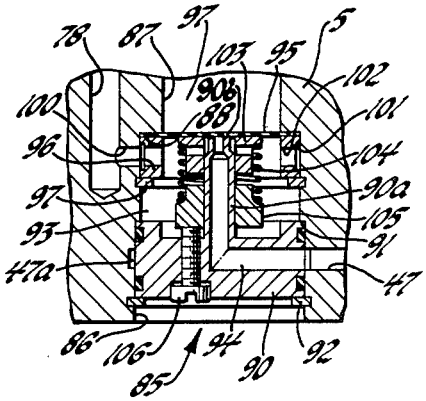
FIG. 5 is a sectional view taken along a line corresponding to line 5—5 of FIG. 3.

Referring now to the pressure regulator valves 85, these valves are provided in the fuel body 5, which as best seen in FIGS. 3, 5 and 6, is provided with a stepped cross bore therethrough providing at each end a stepped annular internal wall 86 and an annular internal intermediate wall 87 of reduced diameter with radial shoulders 88 interconnecting wall 87 at its opposite ends with the walls 86.

Each pressure regulator valve 85, in the embodiment shown and as best seen in FIG. 5, includes a disc base 90 that is fixed in its associated bore portion defining the internal wall 86 between an intermediate shoulder 91 therein and a retaining ring 92 positioned in a suitable annular groove provided for this purpose in the wall 86. Each disc base 90 provides with the respective internal wall 86 a metered fuel supply chamber 93 having an upstanding boss 90*a* therein, including a passage 94 therethrough which is in communication via an annular fuel groove 47*a* in the fuel body 5 with the passage 47 therein. A diaphragm 95 is secured between an associated shoulder 88 and a retainer ring 96 axially fixed by a split retaining ring 98 positioned in a suitable annular groove also provided in the wall 86 for this purpose. This diaphragm 95 defines with the wall 87 a control chamber 97 and it separates the associated supply chamber 93 from the control chamber 97, which in the embodiment shown serves as a common control chamber for both of the pressure regulator valves 85.

Metered fuel from the cross passage 78 in the fuel body 5 is supplied to each of the supply chambers via passages 100, each such passage 100 being in communication at one end with an end portion of the cross passage 78 and at its other end being in communication with an associated annular groove 101 provided, for example, on the exterior of the respective retainer ring 96 and then via one or more radial ports 102 in this retainer ring 96. Fuel flow from the supply chamber 93 to the passage 94 for flow to the associated fuel injection nozzle 40 is controlled by the diaphragm 95 which is movable relative to a valve seat 90*b* on the free end of boss 90*a*. A guide member 103, in the form of an axially apertured disc slidably encircles the free end of the associated boss 90*a* and is normally biased for limited axial movement in one direction, that is, toward the diaphragm 95 by means of a calibrated spring 104 abutting at one end against the guide member 103 and abutting at its opposite end against an apertured spring disc 105 that is slidably received on the boss 90*a* and is adjustably positioned thereon in one direction by means of an adjusting screw 106 threadedly engaged in the disc base 90.

Fuel flow to the control chamber 97, on the opposite side of the diaphragms 95 of each of the constant differential pressure valves 85, from the supply chamber 52 is via a control passage 107 having a calibrated orifice 108 therein that extends from the supply chamber 52 to open through the internal wall 87 for flow to the common control chamber 97, as best seen in FIGS. 3 and 6.

Fuel from the control chamber 97 can be returned back to the fuel reservoir R, whereby to control the pressure of fuel in this control chamber, by a drain passage means having a control orifice therein, with the flow through this passage means to the return conduit being controlled, as desired, by a pulse width modulated solenoid valve generally designated 118. Thus, as best seen in FIG. 4, this passage means includes a lateral passage 110 provided in the fuel body 5 in position so that one end thereof is in flow communication with the control chamber 97 and this passage 110 is provided with a calibrated orifice insert 111 therein having a flow orifice area therethrough of a predetermined size which can be further restricted, as desired for controlled fuel flow therethrough, as by having the tapered end of a mixture adjusting screw 112 axially positioned into the orifice opening in the orifice insert 111, the mixture adjusting screw 112 being adjustably threaded into an internally threaded aperture 114 provided in the fuel body concentric and connecting with the lateral passage 110.

There is also provided a stepped bore passage 115 in the fuel body 5 which extends from the upper surface 11 thereof so as to intersect the lateral passage 110 downstream of the orifice insert 111 with reference to flow therethrough and, this bore passage 115 is in turn in fluid communication intermediate its ends via an intersecting port passage means 116 with the drain passage 54. Flow from the control chamber 97 through the lateral passage 110 to the side port passage means 116 for drainage out through the drain passage 54 is controlled by the normally open, pulse width modulated solenoid valve 118 that is operative, as desired, to control fuel flow through a metering orifice in this assembly.

Thus in the embodiment shown, this solenoid valve assembly 118 includes a valve cage 120 which is provided with a reduced diameter, free end portion 121 that is guidingly and sealingly received in an intermediate diameter portion of the bore passage 115. This valve cage 120 is also provided with a metering orifice passage 122 therethrough which is open at one end into the lower end of bore passage 115 with reference to the drawings and which at its opposite end opens through a valve seat 123 encircling this metering orifice passage into an enlarged return fuel chamber 124 provided in the valve cage.

Figure 4:
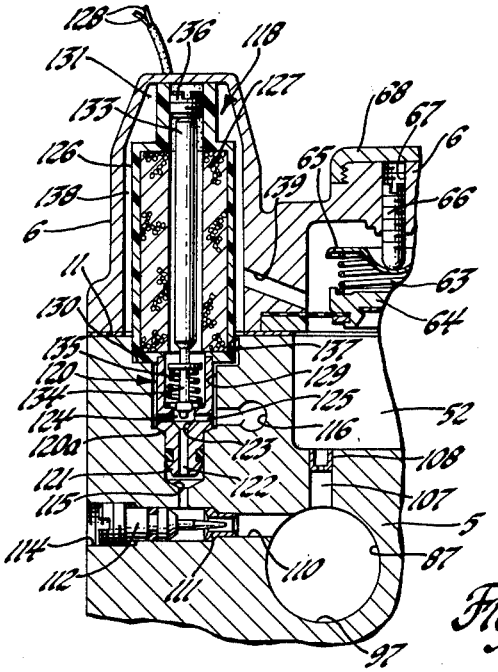
FIG. 4 is a sectional view taken along line 4—4 of FIG. 2.

Fuel chamber 124 is in turn in communication via one or more radial drain ports 125, extending through the side wall of the valve cage, with an annular fuel chamber 129 defined by an intermediate portion of the bore passage 115 and the upper outer peripheral surface of the valve cage 120, this fuel chamber in turn being in direct flow communication with the passage means 116, as shown in FIG. 4. Also as shown in this Figure, a shoulder 120*a* of the valve cage 120 abuts against an internal radial shoulder of the fuel body 5, as provided by the interconnecting wall between adjacent stepped portions of the bore passage 115, and the opposite end of the valve cage 120 is suitably abutted against the lower end of the tubular bobbin 126 of the solenoid valve assembly. Bobbin 126 has a magnetic wire, solenoid coil winding 127 wrapped therein with this coil winding 127 being connected, as by electrical leads 128, to a suitable source of electric power, not shown, as controlled by a suitable electronic control circuit, not shown, whereby the solenoid can be energized, for a purpose to be described, in a pulse width modulated fashion as a function of operating conditions of the engine in a manner well known in the electronic fuel injection art.

Bobbin 126 is located by and is axially positioned in one direction by abutment at its lower end against a radial shoulder 130 provided in the fuel body 5 with the upper end of the bobbin 126, with the solenoid coil winding 127, therein projecting upward into a cavity 131 provided for this purpose by a hollow domed portion of cover 6. An armature 133 is movably received in the armature core provided by the annular coil winding 127 and abuts at its lower end against a valve 134 that is positioned in the fuel return chamber 124 of the valve cage 120 for movement therein relative to valve seat 123, whereby to control the fuel flow through the metering orifice passage 122 to the fuel return chamber 124, this valve 134 and, therefore, the armature 133 being normally biased axially in a direction, upward with reference to FIG. 4, so as to effect unseating of valve 134 relative to valve seat 123 by means of a calibrated spring 135 encircling the lower stem of the valve 134, with one end thereof abutting against the valve cage 120 and its other end abutting against a radial shoulder of valve 134. The movement of the armature 133 in this upward direction being limited as by a stop 136 adjustably threaded into the upper internally threaded end of the bobbin 126.

As shown in FIG. 4, fuel chamber 129 is also in communication via a groove passage 137 in fuel body 5 with an annular chamber 138 defined between bobbin 126 and cover 6, which in turn is in communication by means of a passage 139 with the chamber 61 of the fuel pressure regulator 53 whereby this chamber is subjected to pressure in the fuel tank or reservoir R through the drain passage means described.

Reference is now made to the drawings and, in particular, to FIG. 7, which schematically illustrates the subject throttle body injection apparatus as used, for purposes of illustration only, to supply a controlled air-fuel mixture to a single induction passage 7. During engine operation fuel is supplied to the apparatus 1 in a conventional manner by the pump P from the fuel reservoir R at a suitable pressure and volume via the conduit fitting 51 and inlet passage 50 to the supply chamber 52 so that the fuel pressure regulator 53 can be operative so as to maintain the pressure of fuel in the supply chamber 52 constant, for example, at a substantially constant supply pressure within this chamber of 10 psi.

During normal engine operation, induction air flow through an induction passage 7, as controlled by operator movement of the associated throttle valve 17, will effect pivotal movement of the associated air valve 21 therein against the calibrated closing bias of its associated spring 23, as known in the carburetor art. In the subject structure, the pivotal movement of an air valve 21 will effect corresponding pivotal movement of the pivot shaft 22 and, therefore, of the cam 81 fixed thereto. Movement of cam 81 will in turn, control the axial position of the metering rod 80 so as to effect an increase or decrease in the effective flow area through the bore 73 whereby to meter a fuel quantity that is proportionate to the pivotal position of the air valve 21. Fuel thus metered by the metering valve 70 flows to the metered fuel supply chamber 93 on one side of the diaphragm 95 in the associated pressure regulator valve 85, with the fuel thus metered then flowing from this metered supply chamber to the associated injection nozzle 40 as further controlled by operation of this valve 85.

Of course, in a pressure carburetor or throttle body injection apparatus with two induction passages 7, as shown in FIGS. 1 through 6 inclusive, this fuel flow, as metered by metering rod 80, would be substantially equally divided through the arrangement shown whereby equal quantities of metered fuel would flow to each of the metered fuel supply chambers 93 of the pair of pressure regulator valves 85.

At the same time metered fuel is supplied to the supply chamber 93, fuel from chamber 52 will also flow to the control chamber 97 on the opposite side of the diaphragm of the valve 85, with this flow being controlled by the fuel metering orifice 108. The pressure differential thus established across the diaphragm 95 will be operative to control the pressure drop across the fuel metering valve 70 and therefore the actual fuel flow through the metered supply chamber 93 to the fuel injection nozzle 40. In the case of the structural embodiment shown, the control chamber 97 is formed as a common control chamber for both of the constant differential pressure valves 85.

The pressure of fuel in the control chamber 97 is further regulated, as desired, by the controlled drainage of fuel therefrom back to the fuel reservoir R with this drainage flow controlled by the orifice passage in orifice insert 111 as predetermined and controlled by the mixture adjusting screw, and by the controlled flow through the metering orifice passage 122 as regulated by operation of the valve 134 of solenoid valve 118. As previously described, the solenoid valve 118 is energized, as desired, as a function of engine operation in a manner well known in the electronic fuel injection art. It will be apparent to those skilled in the art that the rich mixture authority adjustment for a particular engine can be preset, as desired, by axial adjustment of the mixture adjusting screw 112 relative to the orifice insert 111.

It will now be apparent to those skilled in the art that open loop control of the air-fuel mixture supplied to the engine is effected by the air valve actuated cam 81 controlled movement of the metering rod 80 of the fuel metering valve 70 and that closed loop control of the air-fuel mixture, for example in the range of 13:1 to 18:1 is effected by operation of the pulse width modulated solenoid valve 118, as desired, whereby to control the pressure differential across the diaphragm 95 of the pressure regulator valve or valves 85 so as to increase or decrease the pressure drop across the outlet from the fuel metering valve fuel flow therefrom to the associated supply chamber 93 and therefore to the related fuel injection nozzle 40.

As is known during cold start of an engine and during engine warm-up operation, air-fuel ratios richer than those identified above for normal engine operation are required. Accordingly, for cold starts at which time a very rich air-fuel ratio or rich induction mixture of, for example, 1:1 is desired, there is provided in the subject throttle body injection apparatus a cold start fuel enrichment arrangement whereby fuel from the supply chamber 52 can be delivered directly to the metered supply chamber 93 of a pressure regulator valve 85 whereby to effect an increase in the flow of fuel to the associated fuel injection nozzle 40, this additional fuel flow being controlled by a crank solenoid valve 140 which is electrically connected by electrical leads 141 to a source of electric power through the engine starter circuit, not shown, in a suitable manner known in the art, whereby this valve 140 is only energized during engine cranking under cold start-up conditions, below a predetermined temperature, as desired.

As shown in FIG. 6, fuel body 5 is provided with an enlarged cavity 142 therein that extends upward from the lower surface 12 thereof to terminate at an internal wall 12*a* and, with a stepped bore 143 that extends upward from the wall 12*a* to intersect, at its upper end, one end of a transverse passage 144, this passage 144 at its opposite end opening into the cross passage 78.

Crank solenoid valve 140, in the construction shown, includes a valve cage 145 suitably fixed to a tubular solenoid bobbin 146 that has a magnetic wire, coil winding 147 therein which is attached to the electrical leads 141. This assembly is suitably fixed to the fuel body 5, as by having the externally threaded portion 145*a* of the valve cage threadedly engaged into the internally threaded portion at the lower end of bore 143 and the valve cage is then locked in position by a nut 149 in an axial position at which the free end of the valve cage 145 sealingly abuts against a radial shoulder 148 that interconnects stepped portions of the bore 143. In the embodiment shown, the bobbin 146 and the lower portion of valve cage 145 extend below the fuel body 5 into a suitable cavity 150 provided for this purpose in the throttle body 4.

Valve cage 145 is provided with a stepped through bore 151 therethrough concentric with the cylindrical core of the bobbin 146, the bore 151 providing an orifice passage 152 at the free end of the valve cage, with this orifice passage 152 thus being positioned in flow communication with the transverse passage 144 via the upper portion of bore 143. At its opposite end the orifice passage 152 is encircled by an internal valve seat 153 within the valve cage. Next adjacent to the valve seat 153, the valve cage 145 is provided with one or more radial ports 154 which open at one end into the bore 151 and at which their other ends are in flow communication with an annular fuel chamber 155 defined by an internal wall of the fuel body 5, as provided by a portion of the bore 143, and by the exterior wall portion of the valve cage 145 adjacent thereto, this fuel chamber 155 being supplied with fuel from the supply chamber 52 by an inclined connecting passage 156 formed in the fuel body.

A valve member 157 is slidably received in the bore 151 of valve cage 145 for axial movement relative to the valve seat 153 and it is operatively connected to an armature 158, as by being formed integral therewith, which is slidably received in the cylindrical core of bobbin 146. Armature 158 is normally biased in an axial direction whereby the tip of valve member 157 is seated against valve seat 153 by means of a coiled spring 160 positioned in the cylindrical core of bobbin 146 so as to abut at one end against a spring seat disc 161 that is secured against axial movement in one direction in the bobbin 146, as by a retaining ring 162 positioned in a suitable annular groove provided for this purpose in the bobbin 146.

As best seen in the schematic illustration in FIG. 7, the connecting passage 156, chamber 155, bore 151 with its orifice passage 152 therein, the passage provided by bore 143 and passage 144 form, in effect, a bypass fuel flow passage means around the valve actuated fuel metering rod controlled fuel passage means with flow through this bypass passage controlled by the solenoid valve 140 whereby fuel from the supply chamber 52 at constant supply pressure can be directly supplied via the metered supply chamber 93 to the associated fuel nozzle 40 so as to provide a rich air-fuel induction mixture at a 1:1 ratio, for example, to the engine during a cold start below a predetermined temperature, with such increased fuel flow occurring for a predetermined time interval as desired, by controlled energization of the crank solenoid valve 140 by means of the starting circuit for the engine in a manner well known in the art.

The subject throttle body injection apparatus is also provided with an automatic choke device, only the shaft 165 and coil 164 of which are shown, since such choke devices are well known and presently used on modern day carburetors and, since the specific details of the construction of such a device are not deemed necessary for an understanding of the subject invention.

However, as is well known, in this type of automatic choke device, a temperature responsive element, usually a coiled bimetal, with preferably an electric heater associated therewith, is positioned in heat exchange relationship with the engine and is operatively connected, in a conventional carburetor, to a choke shaft so as to urge the same in a pivotal direction so that the conventional choke or air valves attached to the choke shaft are moved in a closing direction with a force dependent upon ambient operating temperatures. With such an automatic choke device, the choke or air valve opening force is supplied by making each such valve of unbalanced construction whereby air flow through the associated induction passage will tend to open the valve. In addition, a manifold vacuum responsive member may also be utilized to modify the action of the coiled bimetal during the starting and warm-up periods of engine operation.

In the embodiment shown, the choke coil shaft 165 has a portion thereof pivotally journaled in a suitable manner in the throttle body 4 so as to extend through an enlarged cavity 166 provided in the throttle body and, this choke coil shaft 165 has a cam 167, of predetermined profile, preferably adjustably fixed thereto for rotation therewith. This cam 167 is used to control movement of a choke controlled metering valve that is operatively positioned to control flow through a drain bypass passage means used to drain fuel from the control chamber 97 of the constant differential pressure valve 85 directly to the fuel reservoir R whereby to reduce the control pressure of fuel in this control chamber 97, as desired, so as to effect increased fuel flow from the metered supply chamber 93 to the associated fuel nozzle 40 whereby to enrich the air-fuel mixture supplied to the engine up to a ratio of, for example, 8:1 during engine warm-up operating condition. In addition, since the cam 167 is adjustably fixed to the coil shaft 165, it can be rotatably positioned thereon so as to also act as a fast idle cam.

For this purpose, in the construction shown, the fuel body 5 has a depending boss 5' which projects into a cavity 166 provided in the throttle body, this boss 5' terminating at an end wall 168. The fuel body 5 is provided with a stepped bore to provide an internally threaded reduced diameter bore passage 170 which extends from the internal wall of the fuel body which defines the control chamber 97, and an enlarged diameter bore passage 170*a* that extends through the wall 168. The fuel body 5 is also provided with an internal conduit passage 171 that extends from the drain passage 54 in fuel body 5 to intersect the bore passage 170*a* closely adjacent to the passage 170.

A valve body 172 has its reduced diameter externally threaded, upper portion threadingly secured into the bore passage 170 and has its other end loosely received in the bore passage 170*a* to form therewith an annular fuel chamber 173. Valve body 172 is provided with a stepped axial bore therethrough to provide in succession, starting from its upper portion a first passage 174 and a stem guide and orifice passage 175 and, this valve body is also provided with one or more radial ports 176 to provide flow communication from the passage 174 to the fuel chamber 173. Flow through the orifice portion of passage 175 is controlled by a tapered metering rod 177 which has its stem portion slidably received in the stem guide and orifice passage 175 so that its tapered end portion is movably positioned whereby to control the flow area of the orifice portion of passage 175 extending between the passage 174 and radial ports 176. The opposite end of the tapered metering rod 177 extends outward from the valve body 172 to a position at which its enlarged head 177*a* is engaged by a push rod 178.

The push rod 178 is slidably guided in a cup-shaped cover 180 that is fixed as by screws 181 to the end wall 168 of fuel body 5, with one end of the push rod 178 positioned in axial alignment with the head 177*a* of the metering rod and with itsother end positioned to ride on the cam 167, as biased thereagainst by a coiled spring 182 encircling the lower end of valve body 172 so that one end thereof abuts against an external shoulder of the valve body while its other end abuts against the underside of head 177*a* of the metering rod 177.

In addition, in the embodiment shown, one end of the fuel chamber 173 is defined by a movable roll diaphragm 183 that has its outer peripheral edge sandwiched between the base of cover 180 and the end wall 168. The central, apertured portion of roll diaphragm 183 is suitably fixed to the push rod 178, as by being sandwiched between a radial shoulder of the push rod and a washer 184 fixed to the push rod, as by a nut 185 threaded onto a reduced diameter, externally threaded portion, not shown, of the push rod.

With this arrangement, during warm-up engine operation, up to a predetermined engine operating temperature, the automatic choke device, not shown, will effect pivotal movement of the choke coil shaft 165 and therefore of the cam 167 as a function of temperature, whereby the metering rod is correspondingly axially positioned so as to control added drainage of fuel from the control chamber 97. Accordingly, by additionally dropping the pressure of fuel in the control chamber 97 as a function of temperature below a preselected temperature, the pressure of fuel being supplied to the supply chamber 93 on the opposite side of diaphragm 95 can thus effect further opening movement of the associated diaphragm 95 relative to the inlet of passage 94, whereby to effect increased fuel flow to the associated fuel injection nozzle 40. This additional fuel flow to the fuel injection nozzle for injection into the induction passage 7 will provide for an enriched air-fuel mixture to be supplied to the engine during warm-up engine operation.

As engine operating temperatures increase, the choke coil shaft 165 and therefore cam 167 will be rotated, with reference to FIG. 7, in a counterclockwise direction to effect movement of metering rod 177 in a direction, upward with reference to this Figure, whereby the effective flow area of the orifice portion of passage 175 will be reduced and, at some predetermined operating temperature, the axial position of the metering rod 177 will be such that fuel drain flow through the orifice portion of passage 175 will be prevented and no further fuel enrichment will occur as a result of operating of this engine warm-up fuel enrichment system.

It will now be apparent that, during all modes of engine operation, the subject throttle body injection apparatus will be operative to effect fuel metering as described above for normal engine operation and, that the cold start function and engine warm-up function of the subject apparatus will be operative, as described, so as to supplement this fuel metering flow whereby to provide an enriched air-fuel mixture, as required during cold start and during engine warm-up operation.

Again referring to FIG. 6, the subject throttle body injection apparatus is also provided with a conventional pressure relief valve 186 that is operative so as to relieve pressure in the induction passages 7, in the event ofa possible backfire, so that fuel metering components of the apparatus will not be affected. For this purpose, in the embodiment shown, the fuel body 5 is provided with a stepped bore 187 located so as to extend from the exterior of the fuel body and to open at its opposite end into the adjacent bores 10 extending through the fuel body.

The pressure relief valve 186, in the embodiment shown, includes a disc plate 188 having a central guide bore 190 therethrough and, radially outward of this guide bore, it has one or more discharge ports 191. A mushroom-shaped valve 192 has its stem slidably received in the guide bore 190 and, this valve is normally biased to a position blocking flow out through the discharge ports 191 to the atmosphere, as by means of a calibrated spring 193 positioned so as to encircle the stem portion of the valve 192 with one end thereof in abutment against the disc plate 188 and with its opposite end in abutment against a spring retainer 194 suitably fixed to the stem of the valve adjacent its free end.

This pressure relief valve 186 is positioned within an enlarged portion of the side bore 187 with the disc plate 188 thereof positioned to abut against an internal shoulder 195 provided by a stepped portion of side bore 187, and a split ring retainer 196, suitably positioned in an annular groove provided for this purpose in the fuel body, is used to prevent axial movement of the disc plate 188 away from the shoulder 195.

It will be apparent to those skilled in the art that various changes can be made in the subject throttle body injection apparatus without departing from the spirit and scope of the subject invention. For example, although the crank solenoid valve 140 is shown as controlling bypass fuel flow around the fuel metering valve 70, with this fuel being supplied to the supply chamber 93 of a pressure regulator valve 85 for flow to its associated fuel injection nozzle 40, it will be apparent that this fuel could be supplied directly to the nozzle 40 or nozzles 40.

Accordingly, while the present invention, as to objects and to its advantages, has been described herein as carried out in a specific embodiment thereof, it is not desired to be limited thereby but it is intended to cover the invention broadly within the spirit and scope of the appended claims.

The embodiments of the invention in which an exclusive property or privilege is claimed are defined as follows:

1. A pressure carburetor for an internal combustion engine with an intake manifold, said carburetor including housing means having at least one induction passage therethrough to supply a combustible mixture to the intake manifold of the engine, an air valve means and a spaced apart throttle valve means pivotally mounted for controlling flow through said induction passage; a fuel supply conduit connectable to a source of fuel under pressure; a fuel injection nozzle in said housing means having a spray outlet positioned to discharge fuel into said induction passage; a fuel metering valve in said housing having an inlet connected to said fuel supply conduit, a movable metering member and an outlet for supplying fuel to said fuel injection nozzle; a cam operatively connected to said air valve means and operatively engaged with said movable metering member whereby to effect metering of a fuel quantity through said outlet as a function of the pivotal position of said air valve; a pressure regulator valve in said housing means providing a first chamber separated by a movable wall means from a second chamber, said first chamber being connected to said outlet and having a flow outlet to said injection nozzle with flow through said flow outlet controlled by said movable wall means; a conduit means with a metering orifice therein connecting said second chamber to said fuel supply conduit, a drain conduit means with a flow orifice therein in said housing means connected to said second chamber and connectable to a fuel reservoir for fuel at substantially atmospheric pressure; and, a pulse width modulated solenoid valve operatively associated with said drain conduit means for controlling drainage fuel flow therethrough from said second chamber; whereby said pressure regulator valve is operative to control the pressure drop across said fuel metering valve as a function of engine operation.

2. A pressure carburetor for an internal combustion engine including housing means having at least one induction passage therethrough to supply a combustible mixture to the engine, an air valve means and a spaced apart throttle valve means pivotally mounted for controlling flow through said induction passage; a fuel supply conduit connectable to a source of fuel under pressure; a fuel injection nozzle in said housing means having a spray outlet positioned to discharge fuel into said induction passage; a fuel metering valve in said housing having an inlet connected to said fuel supply conduit, a movable metering member and an outlet for supplying fuel to said fuel injection nozzle; a cam operatively connected to said air valve means and operatively engaged with said movable metering member whereby to effect metering of a fuel quantity through said outlet as a function of the pivotal position of said air valve; a pressure regulator valve in said housing means providing a first chamber separated by a movable wall means from a second chamber, said first chamber being connected to said outlet and having a flow outlet to said injection nozzle with flow through said flow outlet controlled by said movable wall means; a conduit means with a metering orifice therein connecting said second chamber to said fuel supply conduit, a drain conduit means with a flow orifice therein in said housing means connected to said second chamber and connectable to a fuel reservoir for fuel at substantially atmospheric pressure; and, a pulse width modulated solenoid valve operatively associated with said drain conduit means for controlling drainage fuel flow therethrough from said second chamber; whereby said pressure regulator valve is operative to control the pressure drop across said fuel metering valve as a function of engine operation; said housing means further including a second drain passage conduit means therein connected to said second chamber and connectable to the fuel reservoir; a bimetallic choke coil actuated choke coil shaft pivotally journaled in said housing means; a drain metering valve operatively associated with said second drain passage conduit means for controlling flow from said second chamber through said second drain passage conduit means; and a second cam operatively connected to said choke coil shaft and operatively associated with said drain metering valve whereby to effect operation of said drain metering valve as a function of engine temperature.

3. A pressure carburetor for an internal combustion engine including housing means having at least one induction passage therethrough to supply a combustible mixture to the engine, an air valve means and a spaced apart throttle valve means pivotally mounted for controlling flow through said induction passage; a fuel supply conduit connectable to a source of fuel under pressure; a fuel injection nozzle in said housing means having a spray outlet positioned to discharge fuel into said induction passage; a fuel metering valve in said housing having an inlet connected to said fuel supply conduit, a movable metering member and an outlet for supplying fuel to said fuel injection nozzle; a cam operatively connected to said air valve means and operatively engaged with said movable metering member whereby to effect metering of a fuel quantity through said outlet as a function of the pivotal position of said air valve; a pressure regulator valve in said housing means providing a first chamber separated by a movable wall means from a second chamber, said first chamber being connected to said outlet and having a flow outlet to said injection nozzle with flow through said flow outlet controlled by said movable wall means; a conduit means with a metering orifice therein connecting said second chamber to said fuel supply conduit, a drain conduit means with a flow orifice therein in said housing means connected to said second chamber and connectable to a fuel reservoir for fuel at substantially atmospheric pressure; and, a pulse width modulated solenoid valve operatively associated with said drain conduit means for controlling drainage fuel flow therethrough from said second chamber; whereby said pressure regulator valve is operative to control the pressure drop across said fuel metering valve as a function of engine operation; said housing means further including a second drain passage conduit means therein connected to said second chamber and connectable to the fuel reservoir; a bimetallic choke coil actuated choke coil shaft pivotally journaled in said housing means; a drain metering valve operatively associated with said second drain passage conduit means for controlling flow from said second chamber through said second drain passage conduit means; and a second cam operatively connected to said choke coil shaft and operatively associated with said drain metering valve whereby to effect operation of said drain metering valve as a function of engine temperature; said housing means also including a bypass passage means operatively connecting said fuel supply conduit to said first chamber; and, a normally closed, crank actuated solenoid valve operatively connected to said bypass passage means for controlling flow therethrough during cold start of the engine.

4. A pressure carburetor for forming a charge for induction into the intake manifold of an internal combustion engine, said pressure carburetor including a housing means providing a pair of spaced apart throttle bores therethrough; a choke shaft pivotally extending through said throttle bores, a choke valve on each said throttle bores and secured to said choke shaft for movement therewith; a throttle shaft pivotally supported in said housing means and extending through said throttle bores in spaced apart relation to said choke shaft, a throttle valve fixed to said throttle shaft in each said throttle bores; a pair of fuel injection nozzles, each fuel injection nozzle being operatively associated with a respective throttle bore for injecting fuel therein upstream of the associated said throttle valve; a fuel supply conduit means in said housing means for receiving fuel at a predetermined supply pressure; a fuel metering valve in said housing means having an inlet connected to said fuel supply conduit means and an outlet means for supplying fuel to said fuel injection nozzles; said fuel metering valve including a movable metering member for controlling fuel flow from said inlet out through said outlet means; a cam fixed to said choke shaft for movement therewith and operatively engaging said movable metering member whereby to effect metering of a fuel quantity out through said outlet means that is proportional to the pivotal position of said choke shaft; said housing means providing compartment means; a pair of spaced apart diaphragm valve means positioned in said housing to divide said compartment into a supply chamber on one side of each said diaphragm valve means and a common control chamber means on the opposite side of each said diaphragm valve means, each said supply chamber being connected to said outlet means and having a flow outlet connected to an associated said fuel injection nozzle with flow through said flow outlet controlled by an associated said diaphragm valve means; at least one conduit means with a metering orifice therein connecting said fuel supply conduit means to said control chamber means; a drain conduit means in said housing means connected to said control chamber means and connectable to a fuel reservoir for fuel at substantially atmospheric pressure; and, a pulse width modulated solenoid valve operable as a function of engine operating parameters operatively connected to said drain conduit means for controlling fuel drainage from said control chamber means through said drain conduit means to the fuel reservoir whereby to regulate pressure in said control chamber means and therefore the differential pressure acting on said diaphragm valve means as a function of engine operation.

5. A pressure carburetor for forming a charge for induction into the intake manifold of an internal combustion engine, said pressure carburetor including a housing means providing a pair of spaced apart throttle bores therethrough; a choke shaft pivotally extending through said throttle bores, a choke valve on each said throttle bores and secured to said choke shaft for movement therewith; a throttle shaft pivotally supported in said housing means and extending through said throttle bores in spaced apart relation to said choke shaft, a throttle valve fixed to said throttle shaft in each said throttle bores; a pair of fuel injection nozzles each fuel injection nozzle being operatively associated with a respective throttle bore for injecting fuel therein, a fuel supply conduit means in said housing means for receiving fuel at a predetermined supply pressure; a fuel metering valve in said housing means having an inlet connected to said fuel supply conduit means and an outlet means for supplying fuel to said fuel injection nozzles; said fuel metering valve including a movable metering member for controlling fuel flow from said inlet out through said outlet means; a cam fixed to said choke shaft for movement therewith and operatively engaging said movable metering member whereby to effect metering of a fuel quantity out through said outlet means that is proportional to the pivotal position of said choke shaft; said housing means providing compartment means; diaphragm valve means positioned in said housing to divide said compartment into a supply chamber on one side of said diaphragm valve means and a control chamber means on the opposite side of said diaphragm valve means, each said supply chamber being connected to said outlet means and having a flow outlet connected to an associated said fuel injection nozzle with flow through said flow outlet controlled by an associated said diaphragm valve means; at least one conduit means with a metering orifice therein connecting said fuel supply conduit means to said control chamber means; a drain conduit means in said housing means connected to said control chamber means and connectable to a fuel reservoir for fuel at substantially atmospheric pressure; a pulse width modulated solenoid valve operable as a function of engine operating parameters operatively connected to said drain conduit means for controlling fuel drainage from said control chamber means through said drain conduit means to the fuel reservoir whereby to regulate pressure in said control chamber means and therefore the differential pressure acting on said diaphragm valve means as a function of engine operation; and, a regulator means operatively connected to said choke shaft whereby to control the open position of said choke valves so as to maintain a substantially constant pressure drop through said throttle bores across said choke valves.

6. A pressure carburetor for forming a charge for induction into the intake manifold of an internal combustion engine, said pressure carburetor including a housing means providing a pair of spaced apart throttle bores therethrough; a choke shaft pivotally extending through said throttle bores, a choke valve on each said throttle bores and secured to said choke shaft for movement therewith; a throttle shaft pivotally supported in said housing means and extending through said throttle bores in spaced apart relation to said choke shaft, a throttle valve fixed to said throttle shaft in each said throttle bores; a pair of fuel injection nozzles each fuel injection nozzle being operatively associated with a respective throttle bore for injecting fuel therein; a fuel supply conduit means in said housing means for receiving fuel at a predetermined supply pressure; a fuel metering valve in said housing means having an inlet connected to said fuel supply conduit means and an outlet means for supplying fuel to said fuel injection nozzles; said fuel metering valve including a movable metering member for controlling fuel flow from said inlet out through said outlet means; a cam fixed to said choke shaft for movement therewith and operatively engaging said movable metering member whereby to effect metering of a fuel quantity out through said outlet means that is proportional to the pivotal position of said choke shaft; said housing means providing compartment means; diaphragm valve means positioned in said housing to divide said compartment into a supply chamber on one side of said diaphragm valve means and a control chamber means on the opposite side of said diaphragm valve means, each said supply chamber being connected to said outlet means and having a flow outlet connected to an associated said fuel injection nozzle with flow through said flow outlet controlled by an associated said diaphragm valve means; at least one conduit means with a metering orifice therein connecting said fuel supply conduit means to said control chamber means; a drain conduit means in said housing means connected to said control chamber means and connectable to a fuel reservoir for fuel at substantially atmospheric pressure; a pulse width modulated solenoid valve operable as a function of engine operating parameters operatively connected to said drain conduit means for controlling fuel drainage from said control chamber means through said drain conduit means to the fuel reservoir whereby to regulate pressure in said control chamber means and therefore the differential pressure acting on said diaphragm valve means as a function of engine operation; and, a regulator means operatively connected to said choke shaft whereby to control the open position of said choke valves so as to maintain a substantially constant pressure drop through said throttle bores across said choke valves; said housing means further including a second drain passage conduit means therein connected to said control chamber means and connectable to the fuel reservoir; a bimetallic choke coil actuated choke coil shaft pivotally journaled in said housing means; a drain metering valve operatively associated with said second drain passage conduit means for controlling flow from said control chamber means through said second drain passage conduit means; and a second cam operatively connected to said choke coil shaft and operatively associated with said drain metering valve whereby to effect operation of said drain metering valve as a function of engine temperature.

7. A pressure carburetor for forming a charge for induction into the intake manifold of an internal combustion engine, said pressure carburetor including a housing means providing a pair of spaced apart throttle bores therethrough; a choke shaft pivotally extending through said throttle bores, a choke valve on each said throttle bores and secured to said choke shaft for movement therewith; a throttle shaft pivotally supported in said housing means and extending through said throttle bores in spaced apart relation to said choke shaft, a throttle valve fixed to said throttle shaft in each said throttle bores; a pair of fuel injection nozzles each fuel injection nozzle being operatively associated with a respective throttle bore for injecting fuel therein; a fuel supply conduit means in said housing means for receiving fuel at a predetermined supply pressure; a fuel metering valve in said housing means having an inlet connected to said fuel supply conduit means and an outlet means for supplying fuel to said fuel injection nozzles; said fuel metering valve including a movable metering member for controlling fuel flow from said inlet out through said outlet means; a cam fixed to said choke shaft or movement therewith and operatively engaging said movable metering member whereby to effect metering of a fuel quantity out through said outlet means that is proportional to the pivotal position of said choke shaft; said housing means providing compartment means; diaphragm valve means positioned in said housing to divide said compartment into a supply chamber on one side of said diaphragm valve means and a control chamber means on the opposite side of said diaphragm valve means, each said supply chamber being connected to said outlet means and having a flow outlet connected to an associated said fuel injection nozzle with flow through said flow outlet controlled by an associated said diaphragm valve means; at least one conduit means with a metering orifice therein connecting said fuel supply conduit means to said control chamber means; a drain conduit means in said housing means connected to said control chamber means and connectable to a fuel reservoir for fuel at substantially atmospheric pressure; a pulse width modulated solenoid valve operable as a function of engine operating parameters operatively connected to said drain conduit means for controlling fuel drainage from said control chamber means through said drain conduit means to the fuel reservoir whereby to regulate pressure in said control chamber means and therefore the differential pressure acting on said diaphragm valve means as a function of engine operation; and a regulator means operatively connected to said choke shaft whereby to control the open position of said choke valves so as to maintain a substantially constant pressure drop through said throttle bores across said choke valves; said housing means further including a second drain passage conduit means therein connected to said control chamber means and connectable to the fuel reservoir; a bimetallic choke coil actuated choke coil shaft pivotally journaled in said housing means; a drain metering valve operatively associated with said second drain passage conduit means for controlling flow from said control chamber means through said second drain passage conduit means; and a second cam operatively connected to said choke coil shaft and operatively associated with said drain metering valve whereby to effect operation of said drain metering valve as a function of engine temperature; and, said housing means also including a bypass passage means operatively connecting said fuel supply conduit to said first chamber; and, a normally closed, crank actuated solenoid valve operatively connected to said bypass passage means for controlling flow therethrough during cold start of the engine.

8. A mechanical throttle body injection apparatus for continuous injection of fuel into the induction system of an internal combustion engine having an intake manifold, said throttle body injection apparatus including a housing having an induction passage means including means defining at least one throttle bore therethrough with an inlet for air and an outlet for communication with the intaka manifold of an engine, a first valve and a second valve movably positioned in spaced apart relation to each other in said throttle bore for controlling flow therethrough, a fuel supply conduit for the supply of pressurized fuel; fuel nozzle having spray outlet located to discharge fuel into said throttle bore; a fuel metering valve having an inlet connected to said fuel supply conduit and an outlet for supplying fuel to said fuel nozzle said fuel metering valve including a fuel metering rod movably positioned to control flow from said inlet to said outlet and operatively connected to said first valve for movement therewith; a pressure regulator valve having a compartment therein divided by a diaphragm valve means into a supply chamber to said outlet of said fuel metering valve and a control chamber on opposite sides of said diaphragm valve means, said pressure regulator valve having a supply outlet from said supply chamber connected to said fuel nozzle with flow therethrough controlled by said diaphragm valve means; a conduit means with a calibrated flow orifice therein connected to said fuel supply conduit and to said control chamber; a drain passage means with a flow control orifice therein connected at one end to said control chamber and having its opposite end connectable to a low pressure fuel reservoir; a pulse width modulated solenoid actuated drain valve operatively positioned to control flow through said drain passage means; a first bypass passage means with a flow control orifice therein connecting said fuel supply conduit to said supply chamber; a normally closed, crank solenoid actuated valve operatively positioned to control flow through said first bypass passage means and operative whereby to permit additional flow of fuel to said supply chamber for discharge from said fuel nozzle when said crank solenoid actuated valve is energized for effecting cold start of an engine; a second bypass passage means with a control orifice therein having one end thereof in flow communication with said control chamber of said pressure regulator valve and having its opposite end connected to the opposite end of said drain passage means whereby to provide flow bypass around said pulse width modulated solenoid actuated drain valve; and, a bimetallic choke controlled metering valve operatively positioned to control flow through said second bypass passage means whereby the pressure of fuel in said control chamber of said pressure regulator valve can be reduced as a function of said bimetallic choke controlled metering valve operation so as to effect an increase in flow of fuel from said supply chamber to said contant velocity nozzle for discharge into the induction passage means when the engine is cold as a function of engine temperature.

9. A mechanical throttle body injection apparatus for continuous injection of fuel into the induction system of an internal combustion engine having an intake manifold, said throttle body injection apparatus including a housing having an induction passage means including means defining at least one throttle bore therethrough with an inlet for air and an outlet for communication with the intake manifold of an engine; a first valve and a second valve movably positioned in spaced apart relation to each other in said throttle bore for controlling flow therethrough; at least one fuel injecton nozzle having a spray outlet positioned to discharge fuel into said throttle bore; a fuel supply conduit connectable to a source of fuel at a predetermined constant pressure; a pressure regulator valve providing a valve cavity divided by a movable valve means into a supply chamber and a control chamber on opposite sides of said valve means, said pressure regulator valve having a supply outlet from said supply chamber connected to said fuel injection nozzle inlet with flow therethrough controlled by said valve means and a return outlet from said control chamber; a first inlet conduit with a control orifice therein connecting said fuel supply conduit in flow communication with said supply chamber; a second inlet conduit with a calibrated flow orifice associated therewith connecting said fuel supply conduit in flow communication with said control chamber; a fuel metering rod operatively positioned for movement relative to said control orifice whereby to control flow therethrough and operatively connected to said first valve for movement therewith; a drain passage means with a flow control orifice therein connected at one end of said return outlet and having its opposite end connectable to a low pressure fuel reservoir; a pulse width modulated solenoid drain valve opratively positioned to control flow through said drain passage means; a first bypass passage means with a flow control orifice therein connecting said fuel supply conduit to said supply chamber, and with a normally closed, solenoid actuated valve operatively positioned to control flow through said first bypass passage means and operatively connectable to the starting circuit of an engine, said solenoid valve being operative whereby to permit additional flow of fuel to said supply chamber for discharge from said fuel nozzle when said solenoid actuated valve is energized for effecting cold start of an engine; a second bypass passage means with a control orifice therein having one end thereof in flow communication with said control chamber of said pressure regulator valve and having its opposite end connected to the opposite end of said drain passage means whereby to provide flow bypass around said pulse width modulated solenoid drain valve; and, a bimetallic choke controlled metering valve operatively positioned to control flow through said second bypass passage means whereby the pressure of fuel in said control chamber of said pressure regulator valve can be reduced as a function of said bimetallic choke controlled metering valve operation so as to effect an increase in flow of fuel from said supply conduit to said fuel velocity nozzle for discharge into the induction passage means when the engine is cold.

10. A mechanical throttle body injection apparatus for continuous injection of fuel into the induction system connectable to the intake manifold of an internal combustion engine, said throttle body injection apparatus including a housing having an induction passage means including means defining at least one throttle bore therethrough with an inlet for air and an outlet for communication with the intake manifold of an engine, a first valve and a second valve movably positioned in spaced apart relation to each other in said throttle bore for controlling flow therethrough, at least one fuel nozzle having a nozzle inlet and a spray outlet positioned in said housing with said spray outlet located to discharge fuel into said throttle bore between said first valve and said second valve, a pressure regulator valve including a compartment in said housing divided by a diaphragm valve means into a supply chamber and a control chamber on opposite sides of said diaphragm valve means, said housing having a supply outlet from said supply chamber connected to said nozzle inlet with flow therethrough controlled by said diaphragm valve means and a return outlet from said control chamber, said valve housing having a first inlet in communication with said supply chamber and a second inlet with a calibrated flow orifice associated therewith in communication with said control chamber, a passage means having one end thereof connectable to a source of fuel at a predetermined constant supply pressure, the opposite end of said passage means being connected to said first inlet, said passage means including an intermediate outlet connected to said second inlet, said passage means including a fuel metering orifice therein positioned between said opposite end and said intermediate outlet, a fuel metering rod operatively positioned for movement relative to said fuel metering orifice whereby to control flow therethrough and operatively connected to said first valve for movement therewith, a drain passage means with a flow control orifice therein connected at one end to said return outlet and having its opposite end connectable to a low pressure fuel reservoir, a solenoid actuated drain valve operatively positioned to control flow through said drain passage means, a first bypass passage means with a flow control orifice therein connecting said intermediate outlet of said passage means in flow communication with said opposite end of said passage means, a normally closed, solenoid actuated valve operatively positioned to control flow through said first bypass passage means and operative whereby to permit additional flow of fuel to said supply chamber for discharge from said fuel nozzle when said solenoid actuated valve is energized for effecting cold start of an engine, and a second bypass passage means with a control orifice therein having one end thereof in flow communication with said control chamber of said constant differential pressure valve and having its opposite end connected to the opposite end of said drain passage means whereby to provide flow bypass around said solenoid actuated drain valve and a bimetallic choke controlled metering valve operatively positioned to control flow through said second bypass passage means whereby the pressure of fuel in said control chamber of said constant differential pressure valve can be reduced as a function of said bimetallic choke operation so as to effect an increase in flow of fuel from said supply chamber to said constant velocity nozzle for discharge into the induction passage means when the engine is cold.

11. A mechanical throttle body injection apparatus for continuous injection of fuel into the induction system of an internal combustion engine having an intake manifold, said throttle body injection apparatus including a housing having an induction passage means including means defining at least one throttle bore therethrough with an inlet for air and an outlet for communication with the intake manifold of an engine, a first valve and a second valve movably positioned in spaced apart relation to each other in said throttle bore for controlling flow therethrough, at least one fuel injection nozzle having a spray outlet positioned to discharge fuel into said throttle bore and a nozzle inlet, a fuel supply chamber in said housing connectable to a source of fuel at a predetermined constant pressure, a pressure regulator valve including a valve cavity in said housing divided by a movable valve means into a supply chamber and a control chamber on opposite sides of said valve means, a supply outlet in said housing connecting said supply chamber to said nozzle inlet with flow therethrough controlled by said valve means and a return outlet from said control chamber, said housing having a first inlet with a control orifice therein connecting said fuel supply chamber in flow communication with said supply chamber and a second inlet with a calibrated flow orifice associated therewith connecting said fuel supply chamber in flow communication with said control chamber, a fuel metering rod operatively positioned for movement relative to said control orifice whereby to control flow therethrough and operatively connected to said first valve for movement therewith, a drain passage means with a flow control orifice therein in said housing and connected at one end to said return outlet and having its opposite end connectable to a low pressure fuel reservoir, a pulse width modulated solenoid drain valve operatively positioned to control flow through said drain passage means, a first bypass passage means with a flow control orifice therein connecting said fuel supply chamber to said supply chamber, with a normally closed, solenoid actuated valve operatively positioned to control flow through said first bypass passage means and operatively connectable to the starting circuit of an engine, said solenoid valve being operative whereby to permit additional flow of fuel to said supply chamber for discharge from said fuel nozzle when said solenoid actuated valve is energized for effecting cold start of an engine, and a second bypass passage means with a control orifice therein in said housing having one end thereof in flow communication with said control chamber of said constant differential pressure valve and having its opposite end connected to the opposite end of said drain passage means whereby to provide flow bypass around said pulse width modulated solenoid drain valve, and a bimetallic choke controlled metering valve operatively positioned in said housing to control flow through said second bypass passage means whereby the pressure of fuel in said control chamber of said constant differential pressure valve can be reduced as a function of said bimetallic choke operation so as to effect an increase in flow of fuel from said supply chamber to said constant velocity nozzle for discharge into the induction passage means when the engine is cold.

* * * * *

UNITED STATES PATENT AND TRADEMARK OFFICE

CERTIFICATE OF CORRECTION

PATENT NO. : 4,206,735

DATED : June 10, 1980

INVENTOR(S) : Donald L. Miles; Paul E. Reinke

It is certified that error appears in the above-identified patent and that said Letters Patent are hereby corrected as shown below:

Title page, beneath "Assistant Examiner -- Magdalen Moy" insert -- Attorney, Agent, or Firm -- Arthur N. Krein --.

Column 2, line 8, "mannifold" should read -- manifold --.

Column 3, line 15, "of" should read -- or --.

Column 5, line 5, "rod 180" should read -- rod 80 --.

Column 5, line 17, "rod 180" should read -- rod 80 --.

Column 17, line 64, "or" should read -- for --.

Column 18, line 53, "intaka" should read -- intake --.

Column 19, line 68, "of" should read -- to --.

Column 20, line 3, "opratively" should read -- operatively --.

Signed and Sealed this

*Seventeenth* Day of *February 1981*

[SEAL]

*Attest:*

RENE D. TEGTMEYER

*Attesting Officer*

*Acting Commissioner of Patents and Trademarks*